US008141285B2

(12) United States Patent
Brown

(10) Patent No.: US 8,141,285 B2
(45) Date of Patent: Mar. 27, 2012

(54) FIREARM INCLUDING IMPROVED HAND GUARD

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 439 days.

(21) Appl. No.: 12/496,003

(22) Filed: Jul. 1, 2009

(65) Prior Publication Data

US 2012/0036756 A1 Feb. 16, 2012

Related U.S. Application Data

(60) Provisional application No. 61/133,624, filed on Jul. 1, 2008, provisional application No. 61/211,228, filed on Mar. 27, 2009.

(51) Int. Cl.
*F41A 21/00* (2006.01)
*F41C 23/16* (2006.01)
*B23P 11/00* (2006.01)

(52) U.S. Cl. ..... 42/71.01

(58) Field of Classification Search ..... 89/193; 42/72, 71.01, 75.01, 75.02
See application file for complete search history.

(56) References Cited

U.S. PATENT DOCUMENTS 1,379,989 A 5/1921 Johnson
1,402,459 A 1/1922 Swebilius
1,846,993 A 2/1932 Destree
1,878,038 A 9/1932 Von Frommer
2,341,767 A 2/1944 Gans
2,462,119 A 2/1949 Moore
2,685,754 A 8/1954 Crittendon et al.
2,752,826 A 7/1956 Simpson
2,775,166 A 12/1956 Janson
2,780,145 A 2/1957 Saive
2,783,685 A 3/1957 Green
2,882,635 A 4/1959 Hill
2,951,424 A 9/1960 Stoner
3,075,314 A * 1/1963 Bakker ..... 42/71.01
3,090,150 A * 5/1963 Stoner ..... 42/71.01
3,176,424 A 4/1965 Hoge
3,198,076 A 8/1965 Stoner
3,236,155 A 2/1966 Sturtevant (Continued)

OTHER PUBLICATIONS

Article entitled "M26 Modular Accessory Shotgun System" from Wikipedia, the free encyclopdia dated Jun. 2008; http://en.wikipedia.org/wiki/M26_Modular_Accessory_Shotgun_System.

(Continued)

*Primary Examiner* — Troy Chambers
(74) *Attorney, Agent, or Firm* — Howard & Howard Attorneys PLLC

(57) ABSTRACT

A firearm includes a receiver and a barrel connected to the receiver. A hand guard extends from the receiver and defines a hand guard bore. The receiver includes a threaded end and the hand guard includes a flange extending into the hand guard bore and abutting the receiver about the threaded end. A hand guard nut abuts the flange of the hand guard and threadedly engaging the threaded end of the receiver. The hand guard nut sandwiches the flange between the hand guard nut and the receiver for attaching the hand guard to the receiver. The hand guard includes a first hand guard portion and a second hand guard portion removably attached to the first hand guard portion. The second hand guard portion is slid from an assembled position to a disassembled position to expose the hand guard nut in the hand guard bore.

28 Claims, 16 Drawing Sheets

U.S. PATENT DOCUMENTS 3,255,667 A 6/1966 Walther
3,300,889 A 1/1967 Baker
3,368,298 A 2/1968 Browning
3,397,473 A 8/1968 Browning
3,405,470 A 10/1968 Wesemann
3,592,101 A 7/1971 Vartanian et al.
3,618,457 A 11/1971 Miller
3,619,926 A 11/1971 Alday
3,675,534 A 7/1972 Beretta
3,686,998 A 8/1972 Seifried
3,742,636 A 7/1973 Dealy et al.
3,771,415 A 11/1973 Into et al.
3,774,498 A 11/1973 Moller et al.
3,776,095 A 12/1973 Atchisson
3,938,271 A 2/1976 Hyytinen
3,938,422 A 2/1976 Tellie
3,960,053 A 6/1976 Conley
3,969,980 A 7/1976 Brandstatter et al.
3,999,461 A 12/1976 Johnson et al.
4,020,741 A 5/1977 Junker
4,044,487 A 8/1977 Hutton et al.
4,088,057 A 5/1978 Nasypany
4,125,054 A 11/1978 Jennie
4,244,273 A 1/1981 Langendorfer, Jr. et al.
4,246,830 A 1/1981 Krieger
4,358,986 A 11/1982 Giorgio
4,389,920 A 6/1983 Dufour, Sr.
4,398,448 A 8/1983 LaFever
4,505,182 A 3/1985 Sullivan
4,536,982 A * 8/1985 Bredbury et al. ..... 42/71.01
4,553,469 A 11/1985 Atchisson
4,654,993 A 4/1987 Atchisson
4,663,875 A 5/1987 Tatro
4,689,911 A 9/1987 White
4,693,170 A 9/1987 Atchisson
4,703,826 A 11/1987 Byron
4,756,228 A 7/1988 Roth
4,765,224 A 8/1988 Morris
4,766,800 A 8/1988 Miller et al.
4,867,039 A 9/1989 Dobbins
4,893,547 A 1/1990 Atchisson
4,972,617 A 11/1990 Major
5,198,600 A 3/1993 E'Nama
5,343,650 A 9/1994 Swan
5,351,598 A 10/1994 Schuetz
5,540,008 A 7/1996 Kirnstatter
5,590,484 A * 1/1997 Mooney et al. ..... 42/111
5,821,445 A 10/1998 Guhring
5,824,923 A 10/1998 Kondoh et al.
5,824,943 A 10/1998 Guhring et al.
5,826,363 A 10/1998 Olson
5,827,992 A 10/1998 Harris et al.
5,918,401 A 7/1999 Rowlands
5,945,626 A 8/1999 Robbins
6,019,024 A 2/2000 Robinson et al.
6,134,823 A 10/2000 Griffin
6,311,603 B1 11/2001 Dunlap
6,418,655 B1 7/2002 Kay
6,453,594 B1 9/2002 Griffin
6,481,145 B2 11/2002 Weichert et al.
6,499,246 B1 12/2002 Zedrosser
6,564,491 B2 5/2003 Murello
6,609,321 B2 8/2003 Faifer
6,619,592 B2 9/2003 Vignaroli et al.
6,625,916 B1 9/2003 Dionne
6,634,274 B1 10/2003 Herring
6,671,990 B1 * 1/2004 Booth ..... 42/75.01
6,694,660 B1 * 2/2004 Davies ..... 42/75.01
6,722,255 B2 4/2004 Herring
6,732,466 B2 5/2004 Bentley
6,779,288 B1 8/2004 Kim
6,782,791 B2 8/2004 Moore
6,829,858 B2 12/2004 Gablowski
6,848,351 B1 2/2005 Davies
7,000,345 B1 2/2006 Kay
7,131,228 B2 11/2006 Hochstrate et al.
RE39,465 E 1/2007 Swan
7,231,861 B1 6/2007 Gauny et al.
RE40,216 E 4/2008 Swan
7,418,898 B1 9/2008 Desomma
7,448,307 B1 11/2008 Dafinov
7,461,581 B2 12/2008 Leitner-Wise
7,469,624 B1 12/2008 Adams
7,478,495 B1 1/2009 Alzamora et al.
7,640,689 B2 1/2010 Fluhr
7,793,452 B1 * 9/2010 Samson et al. ..... 42/72
7,832,326 B1 * 11/2010 Barrett ..... 89/191.01
7,905,041 B1 * 3/2011 Davies ..... 42/75.02
7,937,870 B2 * 5/2011 Brown ..... 42/16
7,938,055 B2 * 5/2011 Hochstrate et al. ..... 89/193
7,941,959 B1 * 5/2011 Swan ..... 42/85
8,046,949 B1 * 11/2011 Daniel ..... 42/75.02
2003/0074822 A1 4/2003 Faifer
2003/0230022 A1 * 12/2003 Battaglia ..... 42/111
2005/0115134 A1 6/2005 Bond et al.
2005/0115398 A1 6/2005 Olson
2005/0262752 A1 12/2005 Robinson et al.
2006/0065112 A1 3/2006 Kuczynko et al.
2006/0156606 A1 7/2006 Robinson et al.
2006/0236582 A1 10/2006 Lewis et al.
2006/0254112 A1 11/2006 Snoderly
2006/0260169 A1 * 11/2006 Samson et al. ..... 42/72
2007/0033851 A1 2/2007 Hochstrate et al.
2007/0199435 A1 8/2007 Hochstrate et al.
2007/0261285 A1 * 11/2007 Troy ..... 42/75.03
2008/0110074 A1 5/2008 Bucholtz et al.
2008/0301994 A1 12/2008 Langevin et al.
2009/0000173 A1 1/2009 Robinson et al.
2009/0007477 A1 1/2009 Robinson et al.
2009/0031605 A1 2/2009 Robinson
2009/0031606 A1 2/2009 Robinson et al.
2009/0031607 A1 2/2009 Robinson et al.
2009/0056191 A1 3/2009 Battaglia
2009/0178325 A1 7/2009 Veilleux
2010/0300277 A1 * 12/2010 Hochstrate et al. ..... 89/179
2010/0319231 A1 * 12/2010 Stone et al. ..... 42/71.01
2011/0061281 A1 * 3/2011 Kapusta et al. ..... 42/71.01

OTHER PUBLICATIONS

Article entitled "The USA's M4 Carbine Controversy" dated Feb. 2, 2009; www.defenseindustrydaily.com/the-usas-m4-carbine-controversy-03289/.
Article entitled "M4 Carbine Review" dated May 2, 2007; http://home.comcast.net/ shooter2__indy/m4.html.
Article entitled "Critics Turn Crosshairs on Military's Main Rifle" dated Apr. 20, 2008 from the website "USA Today"; www.usatoday.com/news/military/2008-04-20-gunwars__N.htm.
Parts Schematic entitled "Schematic for Bushmaster M4A3 Carbine" from the website "Bushmaster" dated Jun. 2008; www.bushmaster.com/electronic-documents/operation-manual/opmanual.pdf.
Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.
Catalog item LMT: Standard MRP (rifle) version from the website "Lewis Machine Tool Company" dated Jun. 2008; www.lewismachine.net/product.php?p=56&cid=8 &session=85945e8b595ef2d461b8980961cf870a.
Article entitled "M16 rifle" from Wikipedia, the free encyclopedia dated Jun. 2008; http://en.wikipedia.org/wiki/M-16__rifle.
Article entitled "M4 Carbine" from Wikipedia, the free encyclopedia dated Jun. 2008; http://en.wikipedia.org/wiki/M4__carbine.
Animation entitled "How an AR15 Works" from the website dated Jun. 2008; www.barnesengineering.com/AR15animation/index.htm.

* cited by examiner

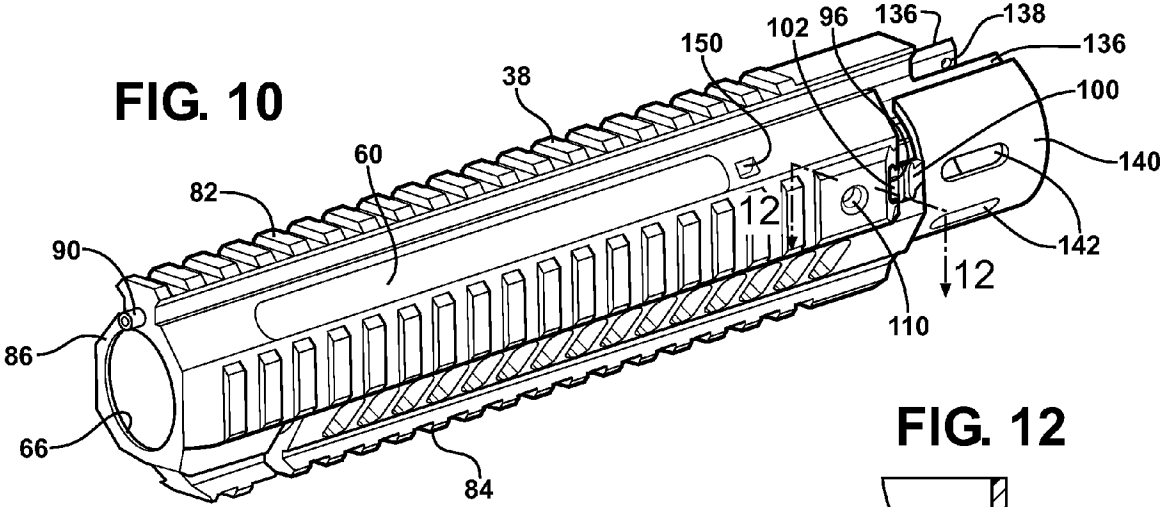
FIG. 10
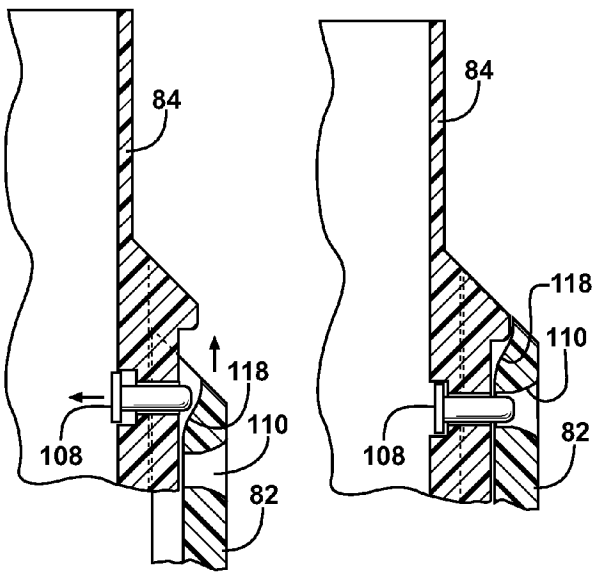
FIG. 12
FIG. 13
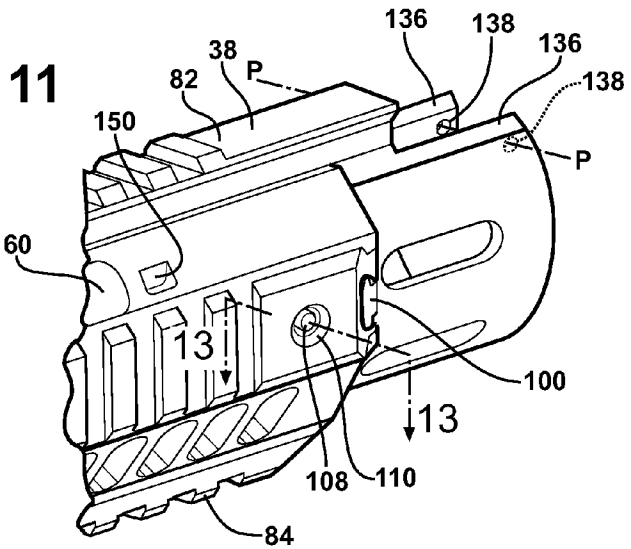
FIG. 11

FIREARM INCLUDING IMPROVED HAND GUARD

CROSS-REFERENCE TO RELATED APPLICATIONS

The subject patent application claims priority to and all the benefits of U.S. Provisional Patent Application No. 61/133,624, which was filed on Jul. 1, 2008; and U.S. Provisional Patent Application No. 61/211,228, which was filed on Mar. 27, 2009.

BACKGROUND OF THE INVENTION

1. Field of the Invention

The subject invention relates to firearms and more specifically to an improved hand guard for a firearm.

2. Description of the Related Art

Firearms typically include a receiver that houses several working components of the firearm, including firing components, with a barrel extending from the receiver. There are various classes of firearms that operate in different manners. One class of firearm utilizes a bolt carrier disposed in the receiver that is moveable between a firing position, from which a live round of ammunition can be fired, and a retracted position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases, including any associated debris, from the barrel, back through a return tube to the bolt carrier, and out the ejection port of the receiver.

Firearms having the indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position.

Often these types of firearms are disassembled and assembled in the field for cleaning and for repair. These types of firearms have complicated construction such that the assembly and disassembly is difficult and time consuming. This is due in part because many of the individual components can not be individually removed but rather multiple components are simultaneously removed and therefore each of the multiple components must be subsequently reassembled. In addition, multiple tools are also required to disassemble and assemble these types of firearms.

While it is occasionally necessary to clean and repair the firearms, such a difficult and time consuming disassembly and assembly is detrimental, especially in stressful situations such as in combat. As such, there remains a need to improve these components and their associated operation.

SUMMARY OF THE INVENTION AND ADVANTAGES

The present invention includes a firearm comprising a receiver defining a receiver bore extending along a longitudinal axis and including a threaded end. A hand guard defines a hand guard bore extending along the longitudinal axis with the hand guard having a flange extending into the hand guard bore and abutting the receiver about the threaded end. A barrel is disposed within the hand guard bore abutting the threaded end. A hand guard nut abuts the flange of the hand guard and threadedly engages the threaded end of the receiver such that the flange is sandwiched between the hand guard nut and the receiver for attaching the hand guard to the receiver.

The present invention also includes the firearm comprising the receiver with the barrel extending from the receiver along the longitudinal axis and defining a bore and a gas port in communication with the bore. A first hand guard portion is attached to the receiver and extends from the receiver along the longitudinal axis about the barrel. A second hand guard portion is removably attached to the first hand guard portion and extends along the longitudinal axis about the barrel with the second hand guard portion selectively moveable between an assembled position engaged with the first hand guard portion and a disassembled position disengaged with the first hand guard portion. A piston assembly is in communication with the gas port of the barrel for receiving exhaust gas from the barrel. A body supports the piston assembly and is attached to the first hand guard portion. The second hand guard portion has a cover at least partially covering the body when the second hand guard portion is in the assembled position to prevent removal of the piston assembly and exposing the body when the second hand guard portion is in the disassembled position to permit removal of the piston assembly.

The present invention also includes the firearm comprising the receiver extending along the longitudinal axis. The first hand guard portion extends along the longitudinal axis with the first hand guard portion having a first end abutting the receiver and a second end spaced from the first end along the longitudinal axis. The second hand guard portion extends along the longitudinal axis and is selectively moveable between an assembled position engaged with the first hand guard portion and a disassembled position disengaged with the first hand guard portion. A groove has an open end and a closed end spaced from each other along the longitudinal axis. A rib is complementary in configuration to the groove and extends along the longitudinal axis. One of the groove and the rib is defined on the first hand guard portion and extends from the second end of the first hand guard portion along the longitudinal axis and the other of the groove and the rib is defined on the second hand guard portion such that the second hand guard portion is slideable along the longitudinal axis from the second end of the first hand guard portion toward the first end of the first hand guard portion to move the second hand guard portion from the disassembled position to the assembled position.

Accordingly, several components of the firearm can be quickly and easily disassembled and assembled, which is advantageous, especially in high stress situations like combat. The second hand guard portion can be quickly and easily removed for providing access to several components of the firearm. The grooves and ribs of the first and second hand guard portions enables the removal of the second hand guard with a mere sliding motion. Also, assembly of the second hand guard portion merely requires aligning the groove and the rib at the second end of the first hand guard portion and sliding the second hand guard portion toward the receiver.

When the second hand guard portion is removed, several components, including the barrel and the piston assembly, can be quickly and easily removed in a modular fashion. Because the body, which supports the piston assembly, is attached to the hand guard portion, removal of the second hand guard portion allows for the removal of the piston assembly as a unit.

The second hand guard portion also protects components within the hand guard from dirt and from accidental disassembly. Because the second hand guard portion is engaged with the first hand guard portion in the assembled position, the second hand guard portion secures and protects the components within the hand guard.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 10 is a perspective view of the hand guard with the second hand guard portion moved from the position of FIG. 9 toward the assembled position.

FIG. 11 is a fragmented view of the hand guard with the second hand guard portion in the assembled position.

FIG. 12 is a fragmented partial cross-sectional view taken along line 12-12 of FIG. 10.

FIG. 13 is a fragmented partial cross-sectional view taken along line 13-13 of FIG. 11.

DETAILED DESCRIPTION OF THE INVENTION

Figure 1:
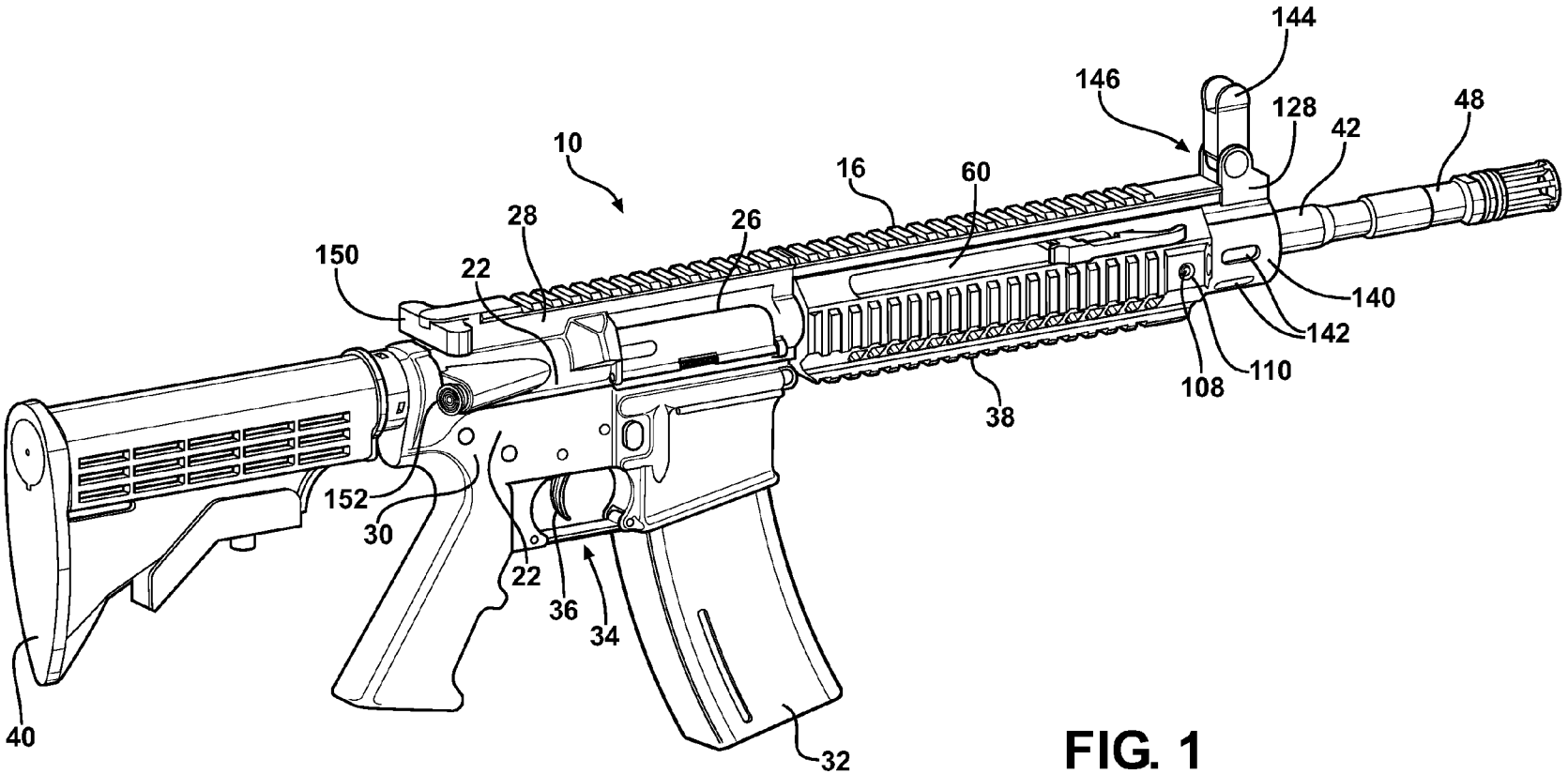
FIG. 1 is a perspective view of an embodiment of a firearm in accordance with the subject invention.

Referring to the Figures, wherein like numerals indicate like or corresponding parts throughout the several views, a firearm 10 is generally shown in FIG. 1. The firearm 10 receives and fires a live round of ammunition (not shown; hereinafter "live round"), also referred to as a cartridge, which includes a casing, a bullet, and other components to propel the bullet as known to those skilled in the art.

The firearm 10 can be of a certain class of firearms 10 that utilize a direct gas impingement system or an indirect gas impingement system to eject a spent casing after firing the firearm 10. Examples of such types of firearms 10 include the M16, the M4®, such as the M4® carbine, and the AR-15®, such as the AR-15® Platform. However, it should be appreciated that the firearm 10 can be of any type without departing from the nature of the present invention. The firearm 10 described herein is designed to permit easy retro-fitting of the components to a variety of currently and/or previously manufactured firearm 10 designs including direct gas impingement systems and indirect gas impingement systems. The indirect gas impingement system utilizes a piston assembly 18 for moving a bolt carrier 20, as further disclosed and claimed in U.S. patent application Ser. No. 12/496,000 filed concurrently with the present application, which is incorporated herein by reference.

Figure 2:
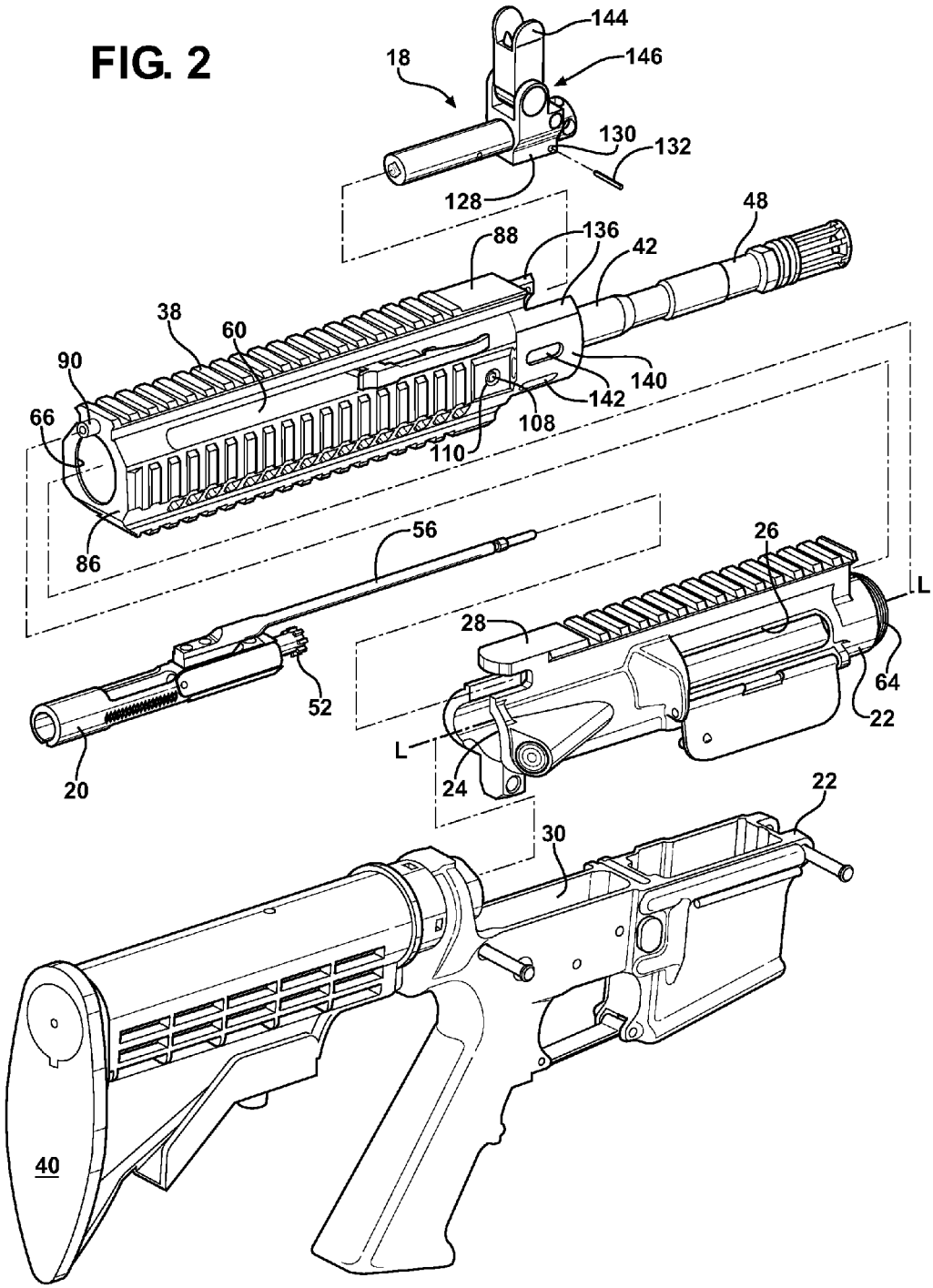
FIG. 2 is an exploded view of the firearm.

As also shown in FIG. 2, the firearm 10 includes a receiver 22 defining a receiver bore 24 extending along a longitudinal axis L and houses several working components of the firearm 10, such as the firing components, i.e. the action. As used herein, the phrase "along the longitudinal axis L" includes components and/or movements aligning with the longitudinal axis L and/or spaced from and substantially parallel to the longitudinal axis L. The receiver 22 defines an ejection port 26 transverse to the longitudinal axis L for discharging spent casings. As known in the art, the receiver 22 is often divided into an upper receiver portion 28 and a lower receiver portion 30 attached to the upper receiver portion 28. The upper receiver portion 28 defines the receiver bore 24 and the ejection port 26

Referring to FIG. 1, a magazine 32, also referred to as a clip, is detachably mounted to the lower receiver portion 30 and can be loaded with a plurality of live rounds. The firearm 10 further includes a trigger assembly 34 supported by the receiver 22. The trigger assembly 34 includes a trigger 36 and a hammer (not shown). The trigger 36 is pulled to move the hammer, which, as discussed further below, ultimately results in the firing of the firearm 10.

The firearm 10 includes a hand guard 38 that extends from the receiver 22 such that a user can hold the hand guard 38 of the firearm 10. The hand guard 38 protects the user's hand from heat generated by the firing of the firearm 10. The hand guard 38 can include a series of connection points that are known in the industry as a rail system 16 for mounting additional components to the hand guard 38. For example, such components can include bipods, tripods, scopes, bayonets, lasers, shot guns, grenade launchers, etc. A buttstock 40 extends rearwardly from the receiver 22 for supporting the firearm 10 against a shoulder 72 of the user. A hand grip extends downwardly along the lower receiver 22 for gripping by the user.

Figure 3:
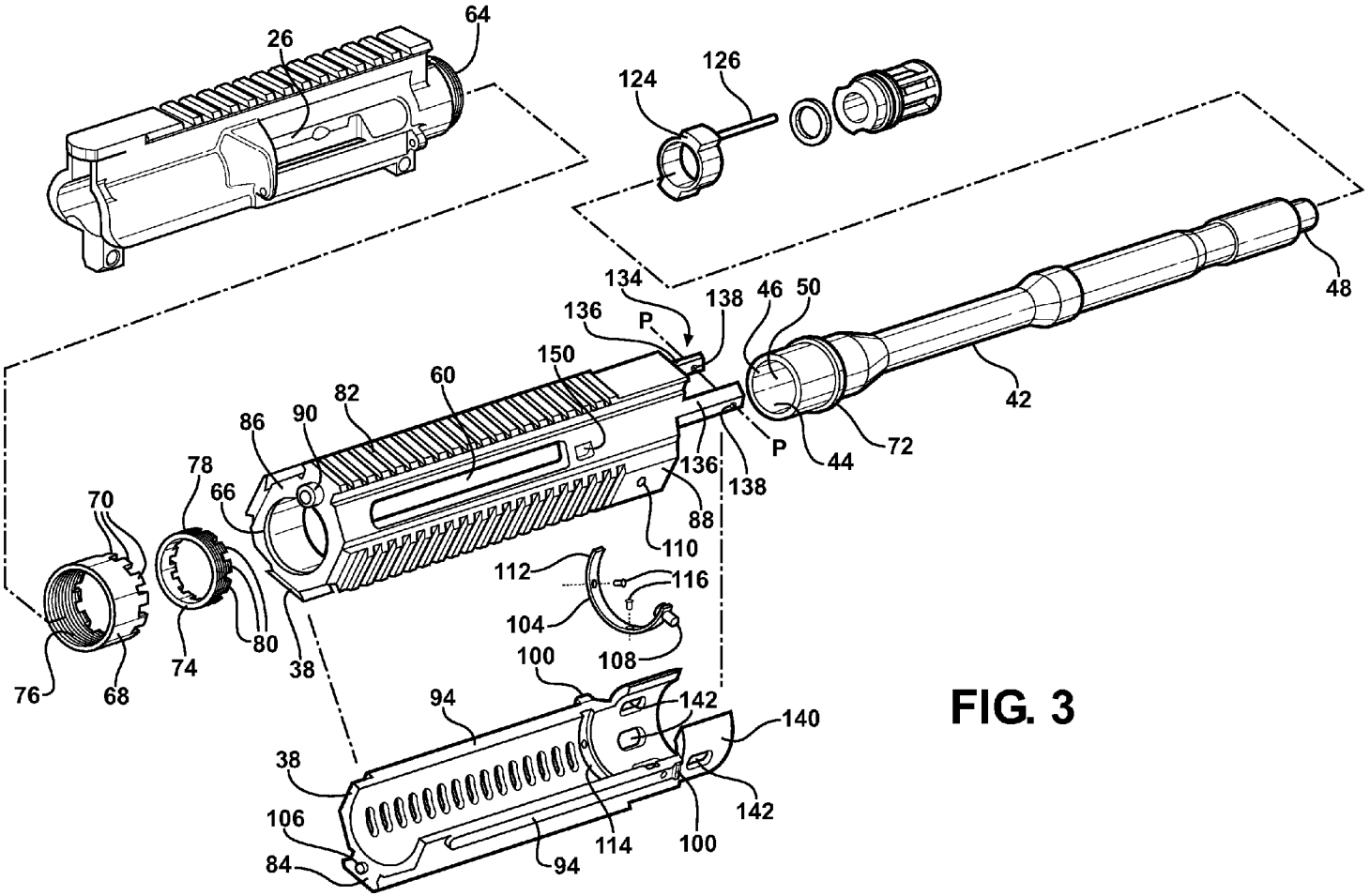
FIG. 3 is an exploded view of a portion of the firearm including a hand guard.

Referring also to FIG. 3, a barrel 42 is coupled to the receiver 22 and defines a barrel bore 44 extending along the longitudinal axis L. The barrel 42 includes a breech 46 adjacent the receiver 22 and a muzzle 48 spaced from the breech 46 along the longitudinal axis L with the breech 46 defining a chamber 50 extending along the longitudinal axis L for receiving one of the live rounds. The live rounds are individually loaded into the chamber 50 from the magazine 32. The chamber 50 aligns with the barrel bore 44 such that the bullet moves out of the chamber 50 and the barrel bore 44 when firing the firearm 10.

With reference to FIG. 2, the bolt carrier 20 is disposed in the receiver bore 24. The bolt carrier 20 is moveable relative to the receiver 22 along the longitudinal axis L between a firing position and a rearward position. Specifically, a bolt 52 and a firing pin 54 are carried by the bolt carrier 20. The bolt carrier 20 typically has features for automatically releasing another live round from the magazine 32 into the chamber 50 as the bolt carrier 20 moves toward the firing position. As the bolt carrier 20 moves from the rearward position toward the firing position, the bolt carrier 20 catches or pushes another live round into the chamber 50 of the barrel 42. In the firing position, the bolt 52 locks to the breech 46 of the barrel 42 to hold the live round in the chamber 50. The firing components can include the bolt carrier 20, the bolt 52, the firing pin 54, the trigger assembly 34, and the hammer and other components as known to those of skilled in the art. A rod 56 is connected to the bolt carrier 20 and is in communication with the piston assembly 18 for transmitting movement from the piston assembly 18 to the bolt carrier 20.

When the bolt 52 is in the firing position, the trigger 36 can be pulled to release the hammer, which strikes the firing pin 54. When the hammer strikes the firing pin 54, the firing pin 54 strikes the live round to fire the live round, which causes the bullet to move through and out of the bore 44 of the barrel 42. After firing the live round, the bolt carrier 20 is moved by a gas impingement system toward the rearward position and the casing, which is now empty, is expelled from the receiver 22. The bolt carrier 20 is automatically moved toward the firing position thereby automatically loading another live round from the magazine 32 into the chamber 50.

As best shown in FIG. 1, a handle assembly 58 is supported by the hand guard 38 for charging and forward assist. The hand guard 38 defines a pair of slots 60 for slideably receiving the handle assembly 58. The handle assembly 58 is further disclosed and claimed in U.S. patent application Ser. No. 12/496,008 filed concurrently with the present application, which is incorporated herein by reference. The hand guard 38 can define a notch 150 to receive a projection of the handle assembly 58. The projection of the handle assembly 58 nests with the notch 150 to retain the handle assembly 66 at a forward end of the hand guard 38.

The firearm 10 can includes a version of a standard charging handle 150 and a version of a standard forward assist mechanism 152. The firearm 10 shown in FIG. 1 is retro-fitted with the handle assembly 58, which can be used to perform the function of both the standard charging handle 150 and the standard forward assist mechanism 152. Alternatively, the firearm 10 can also be produced without the standard charging handle and the standard forward assist mechanism such that only the handle assembly 58 is utilized to perform these functions.

Figure 4:
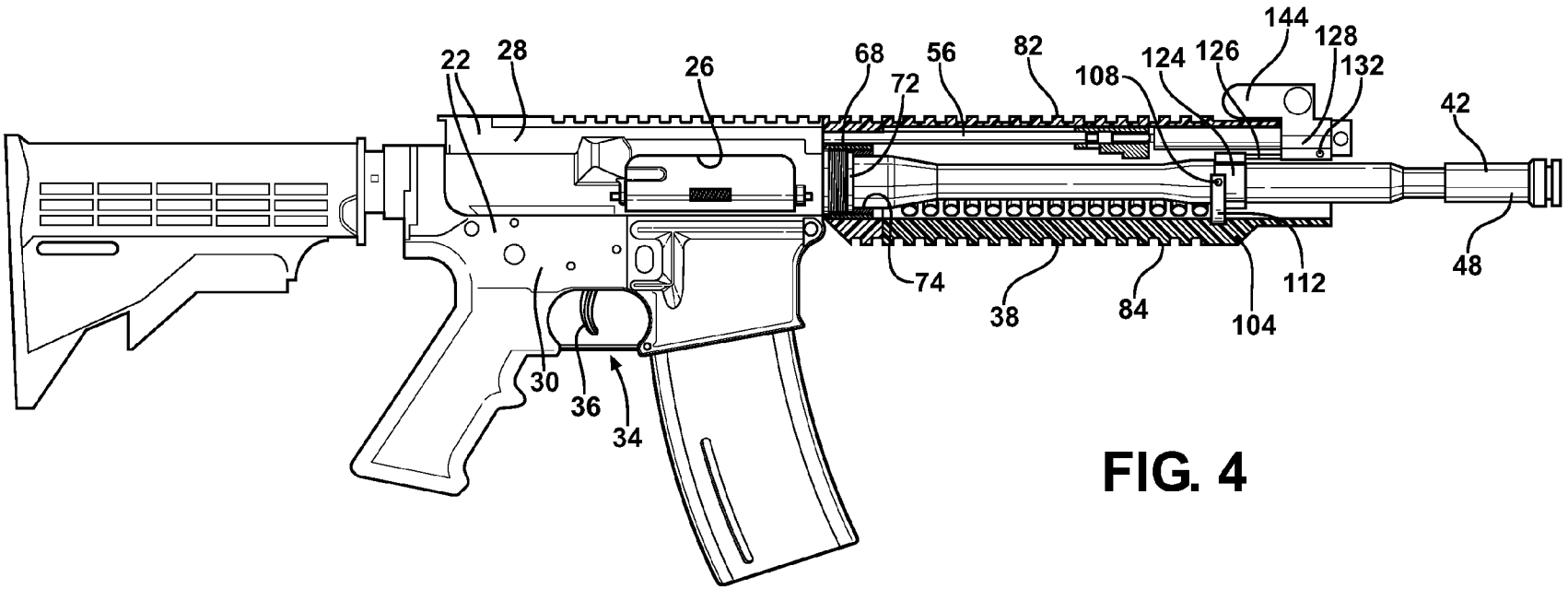
FIG. 4 is a partially cross-sectional view of the firearm.
Figure 5:
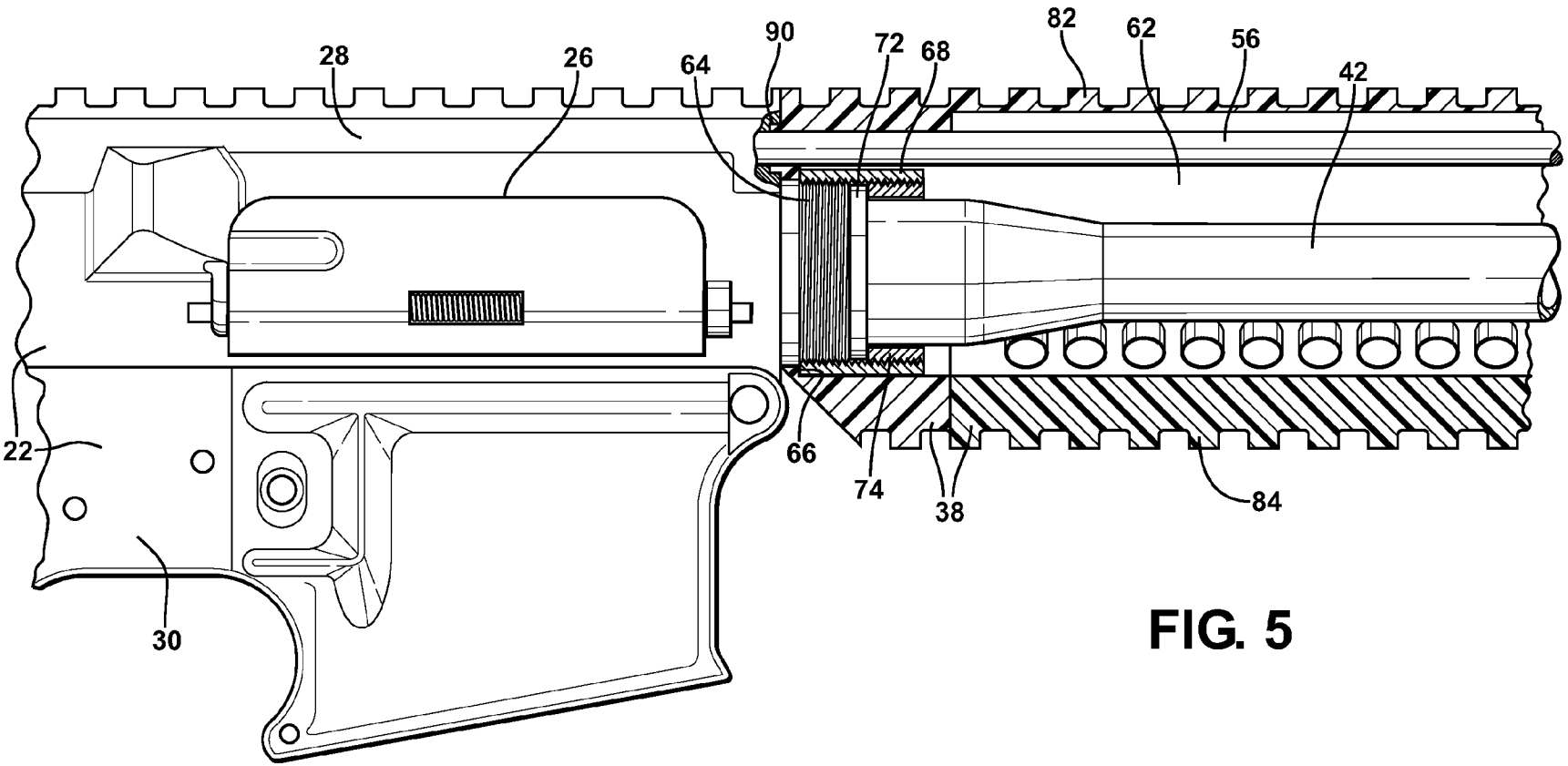
FIG. 5 is a partially cross-sectional magnified view of a portion of FIG. 4.

As shown in FIGS. 4 and 5, the hand guard 38 defines a hand guard bore 62 and is attached to the receiver 22. The receiver 22 includes a threaded end 64 that projects away from the receiver 22 along the longitudinal axis L. The hand guard 38 has a flange 66 extending into the hand guard bore 62 and abutting the receiver 22 about the threaded end 64. In other words, the threaded end 64 extends into the hand guard bore 62 and the flange 66 surrounds the threaded end 64.

A hand guard nut 68 abuts the flange 66 of the hand guard 38 and threadedly engages the threaded end 64 of the receiver 22. The hand guard nut 68 has an outer diameter larger than an inner diameter of the flange 66. When the hand guard nut 68 is tightened to the threaded end 64 of the receiver 22, the flange 66 is sandwiched between the hand guard nut 68 and the receiver 22 for attaching the hand guard 38 to the receiver 22.

Figure 6:
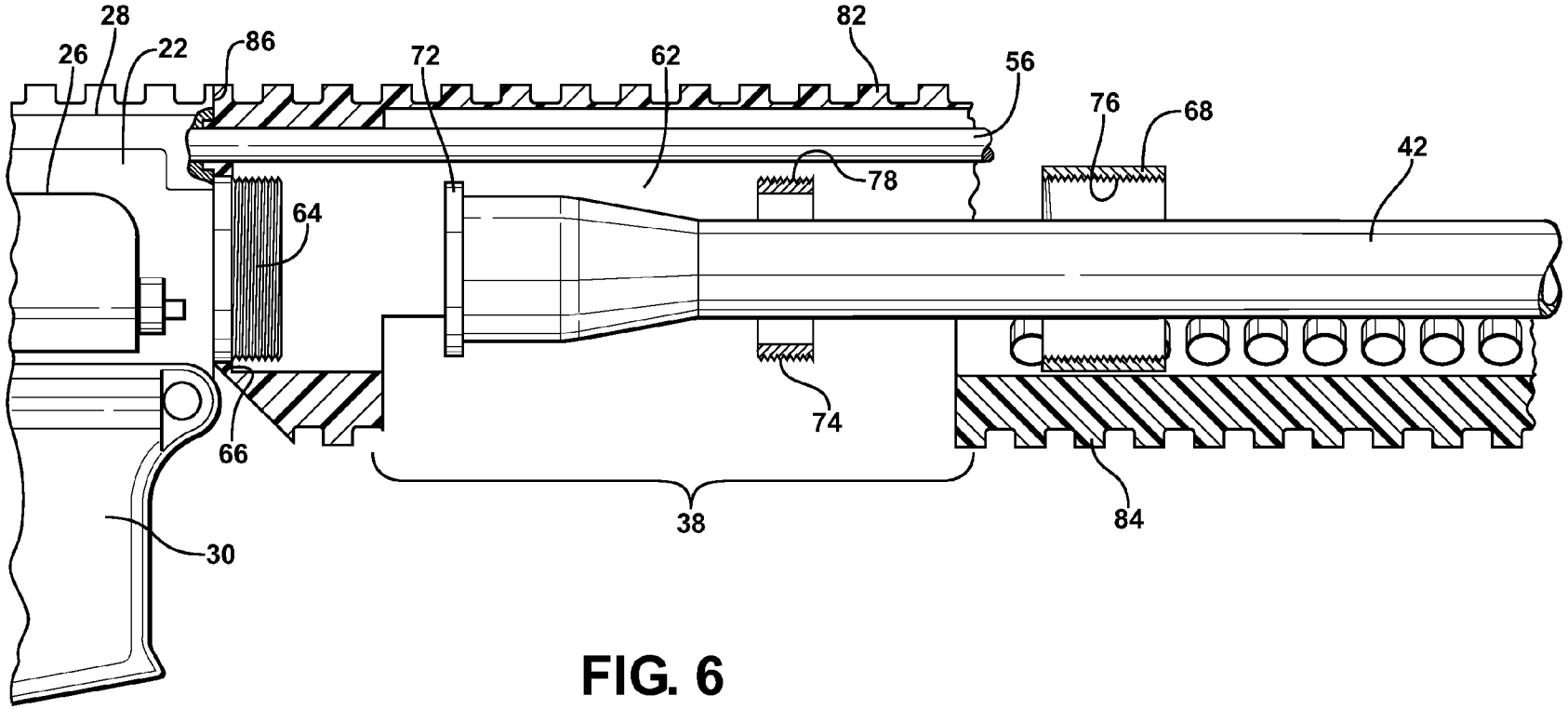
FIG. 6 is an exploded view of the portion shown in FIG. 5.
Figure 7:
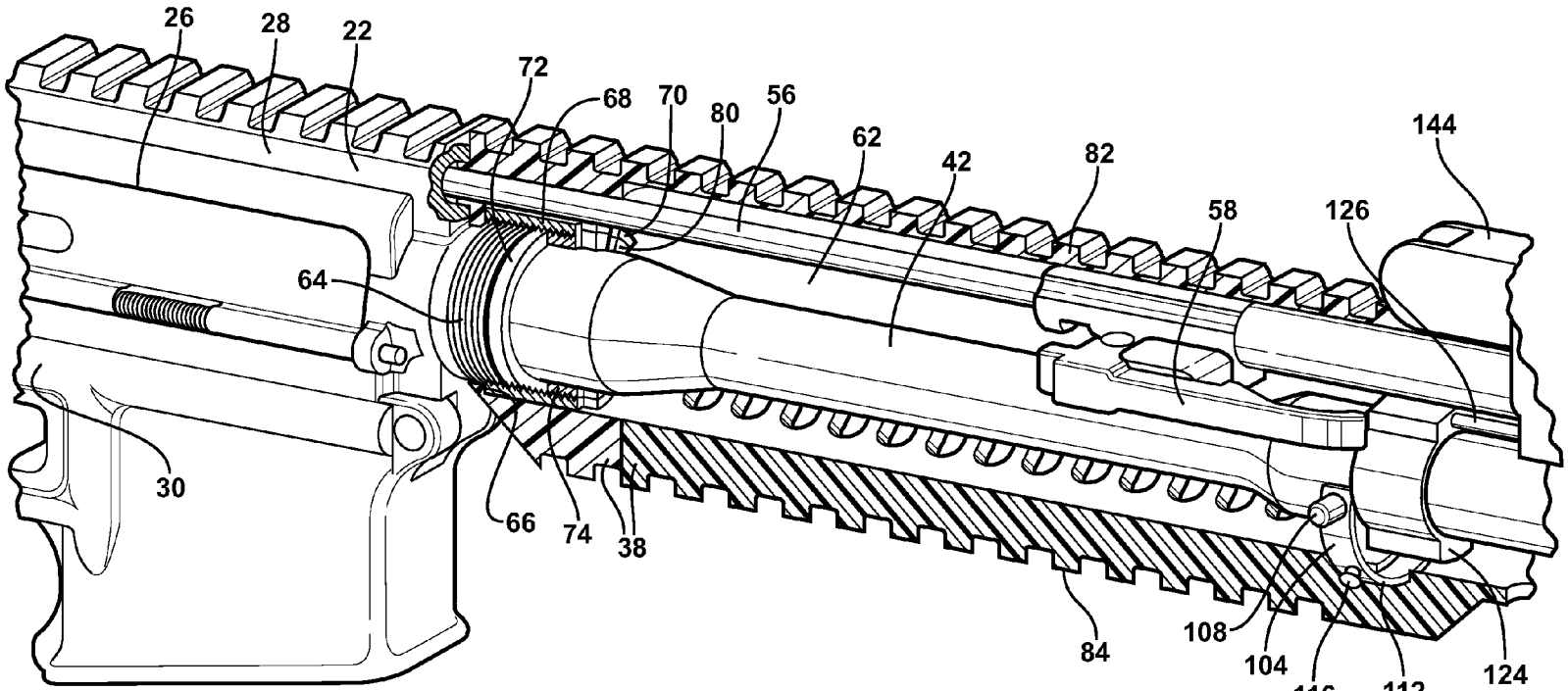
FIG. 7 is fragmented partially cross-sectional view of the firearm.

As best shown in FIGS. 3 and 7, the hand guard nut 68 presents a first set of teeth 70. A tightening tool (not shown) can be inserted into the hand guard bore 62 to engage the first set of teeth 70. When engaged with the first set of teeth 70, the tightening tool can be rotated to threadedly engage or disengage the hand guard nut 68 with the threaded end 64 of the receiver 22. The hand guard nut 68 is shown engaged with the threaded end 64 of the receiver 22 in FIGS. 4, 5, and 7 and is shown disassembled from the threaded end 64 in FIGS. 3 and 6.

The barrel 42 abuts the threaded end 64 of the receiver 22 and extends from the threaded end 64 of the receiver 22 into the hand guard bore 62. The barrel 42 is a "floating barrel," i.e., the barrel 42 is only supported by the receiver 22 and is spaced from and not supported by the hand guard 38. The barrel 42 includes a shoulder 72 that abuts the threaded end 64 of the receiver 22. The shoulder 72 is disposed on the same end of the barrel 42 as the chamber 50.

A barrel nut 74 threadedly engages the hand guard nut 68, which is engaged with the threaded end 64 of the receiver 22, for attaching the barrel 42 to the receiver 22. Specifically, the barrel nut 74 has an inner diameter smaller than an outer diameter of the shoulder 72. The barrel nut 74 abuts the shoulder 72 of the barrel 42 such that, when the barrel nut 74 is tightened to the hand guard nut 68, the shoulder 72 is sandwiched between the barrel nut 74 and the threaded end 64.

The barrel nut 74 and the shoulder 72 of the barrel 42 are disposed in the hand guard nut 68. Specifically, the barrel nut 74 and the shoulder 72 are sized to fit within the hand guard nut 68. The hand guard nut 68 includes internal threads 76 and the barrel nut 74 includes external threads 78 corresponding to the internal threads 76 of the hand guard nut 68. With the shoulder 72 disposed in the hand guard nut 68, the external threads 78 of the barrel nut 74 are engaged with the internal threads 76 of the hand guard nut 68 to thread the barrel nut 74 into the hand guard nut 68.

As best shown in FIGS. 3 and 7, the barrel nut 74 presents a second set of teeth 80. The second set of teeth 80 can have a similar configuration as the first set of teeth 70 such that a similar tightening tool can be used to engage the second set of teeth 80. Specifically, when engaged with the second set of teeth 80, the tightening tool can be rotated to rotate the barrel nut 74 relative to the hand guard nut 68 to threadedly engage or disengage the barrel nut 74 from the hand guard nut 68, i.e., the attach the barrel 42 to the receiver 22 or to disassemble the barrel 42 from the receiver 22.

The hand guard 38 includes a first hand guard portion 82 attached to the receiver 22 and a second hand guard portion 84 connected to the first hand guard portion 82. The first 82 and second 84 hand guard portions extend along the longitudinal axis L about the barrel 42. The first 82 and second 84 hand guard portions 84 define the hand guard bore 62 receiving the barrel 42, i.e., the barrel 42 extends from the receiver 22 through the hand guard bore 62.

Figure 16:
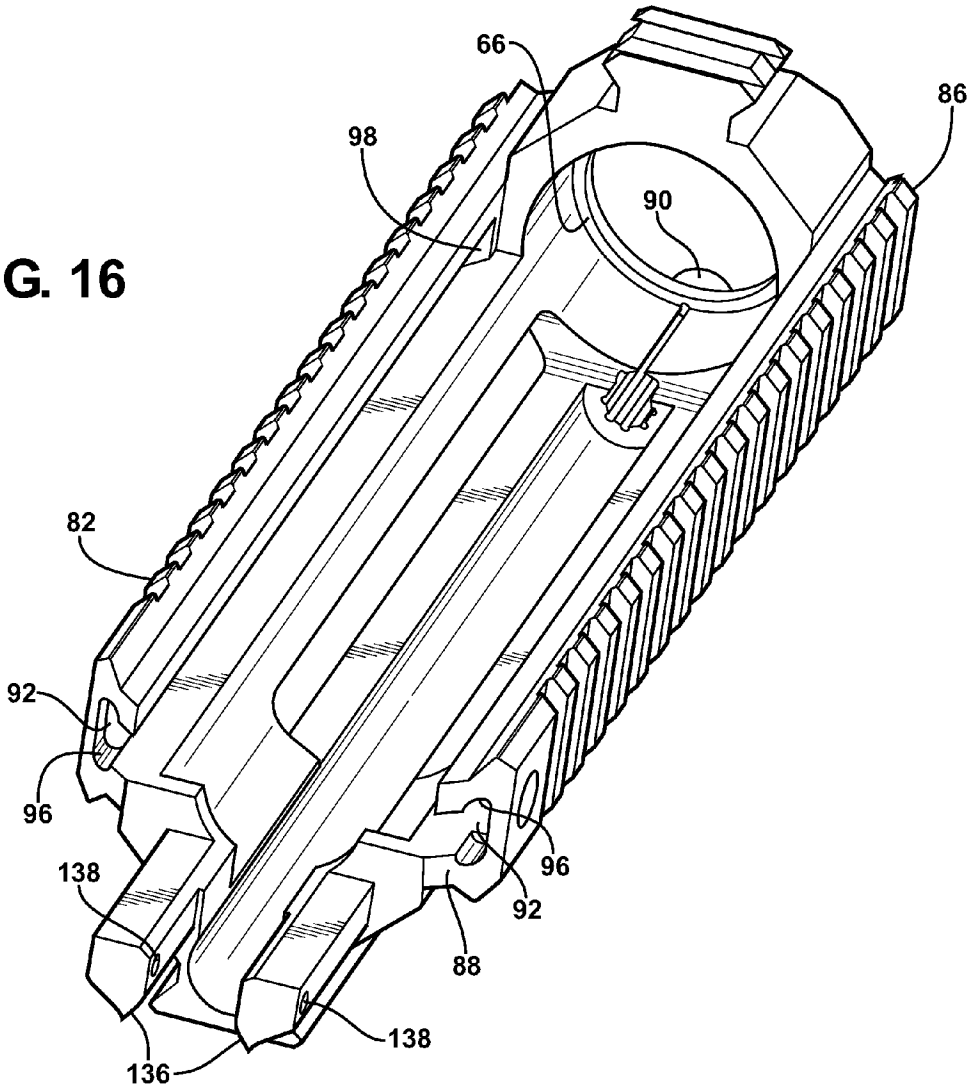
FIG. 16 is an interior perspective view of the first hand guard portion.

The first hand guard portion 82 has a first end 86 abutting the receiver 22 and a second end 88 spaced from the first end 86 along the longitudinal axis L. The first end 86 presents a bushing 90 that extends from the first hand guard portion 82 and is received by an opening in the receiver 22. As shown in FIG. 16, an interior of the bushing 90 is splined and receives the rod 56.

As shown in FIGS. 3, 6, 8-11, and 14-17, the second hand guard portion 84 is selectively moveable between an assembled position engaged with the first hand guard portion 82 and a disassembled position disengaged with the first hand guard portion 82. In other words, the second hand guard portion 84 is removably attached to the first hand guard portion 82. The second hand guard portion 84 can be removed from the first hand guard portion 82, for example, for providing access to the hand guard nut 68 and the barrel nut 74.

One of the first hand guard portion 82 defines at least one groove 92 extending along the longitudinal axis L and the second hand guard portion 84 includes at least one rib 94 extending along the longitudinal axis L. As shown in FIGS. 8, 9, and 14-16, the first hand guard portion 82 defines a pair of grooves 92 extending along opposite sides of the first hand guard portion 82 and the second hand guard portion 84 includes a pair of ribs 94 extending along opposing sides of the second hand guard portion 84. The ribs 94 are complementary in configuration to the grooves 92 and extend in the grooves 92, respectively, along the longitudinal axis L to attach the second hand guard portion 84 to the first hand guard portion 82, i.e., the ribs 94 and the grooves 92 mesh. Preferably, the first hand guard defines the groove 92 and the second hand guard includes the ribs 94. However, alternatively, the second hand guard portion 84 can define the grooves 92 and the first hand guard portion 82 can define the ribs 94.

The groove 92 has an open end 96 and a closed end 98 spaced from each other along the longitudinal axis L. The open end 96 of the groove 92 is disposed at the second end 88 of the first hand guard portion 82. The groove 92 extends from the second end 88 of the first hand guard portion 82 along the longitudinal axis L. The second hand guard portion 84 is slideable along the longitudinal axis L from the second end 88 of the first hand guard portion 82 toward the first end 86 of the first hand guard portion 82 to move the second hand guard portion 84 from the disassembled position to the assembled position.

The groove 92 is continuous along the longitudinal axis L from the open end 96 to the closed end 98. The rib 94 is also continuous along the longitudinal axis L. As such, when the second hand guard portion 84 is in the assembled position, the groove 92 extends continuously from the open end 96 to the closed end 98 of the groove 92. This configuration creates continuous contact between the first hand guard portion 82 and the second hand guard portion 84 to prevent or limit flexing of the first 82 and second 84 hand guard portions relative to each other, which increases the rigidity of the hand guard 38 when the second hand guard portion 84 is in the assembled position.

Figure 14:
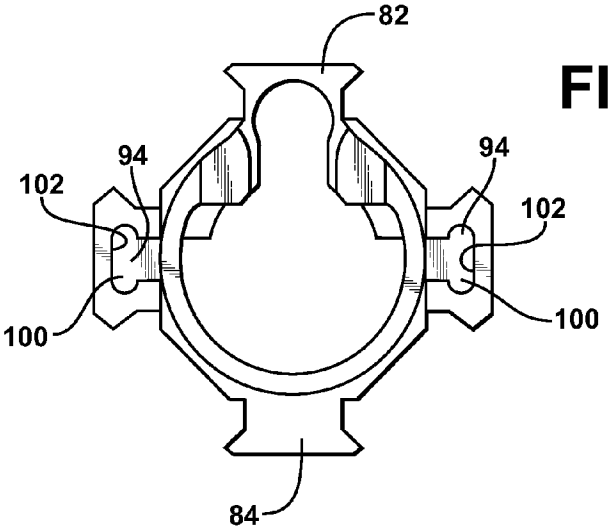
FIG. 14 is an end view of the hand guard.
Figure 15:
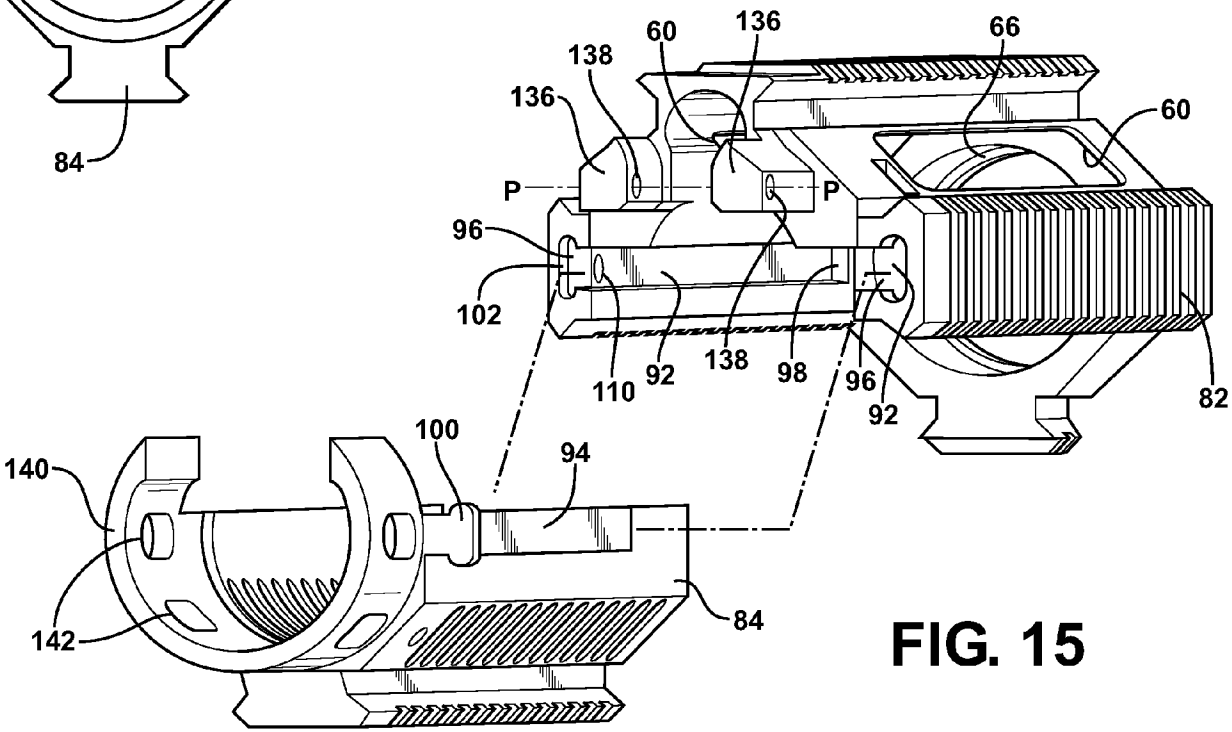
FIG. 15 is an exploded view of the hand guard.

An ear 100 extends from the rib 94 adjacent the second end 88. The groove 92 includes an enlarged section 102 adjacent the second end 88 complementary configuration to the ear 100 for interlocking the first hand guard portion 82 and the second hand guard portion 84, as shown in FIGS. 11 and 14. The engagement of the ear 100 with the enlarged section 102 to interlock the first hand guard portion 82 and the second hand guard portion 84 increases the rigidity of the hand guard 38 when the second hand guard portion 84 is in the assembled position. Specifically, the engagement of the ear 100 in the enlarged section 102 prevents or limits flexing of the first hand guard portion 82 and the second hand guard portion 84 relative to each other, which further increases the rigidity of the hand guard 38 when the second hand guard portion 84 is in the assembled position.

As shown in FIGS. 3, 7, 8-9, and 12-13, a securing device 104 is coupled between the first hand guard portion 82 and the second hand guard portion 84 for retaining the second hand guard portion 84 to the first hand guard portion 82. The securing device 104 automatically couples the first hand guard portion 82 and the second hand guard portion 84 when the second hand guard portion 84 is moved to the engaged position.

Figure 8:
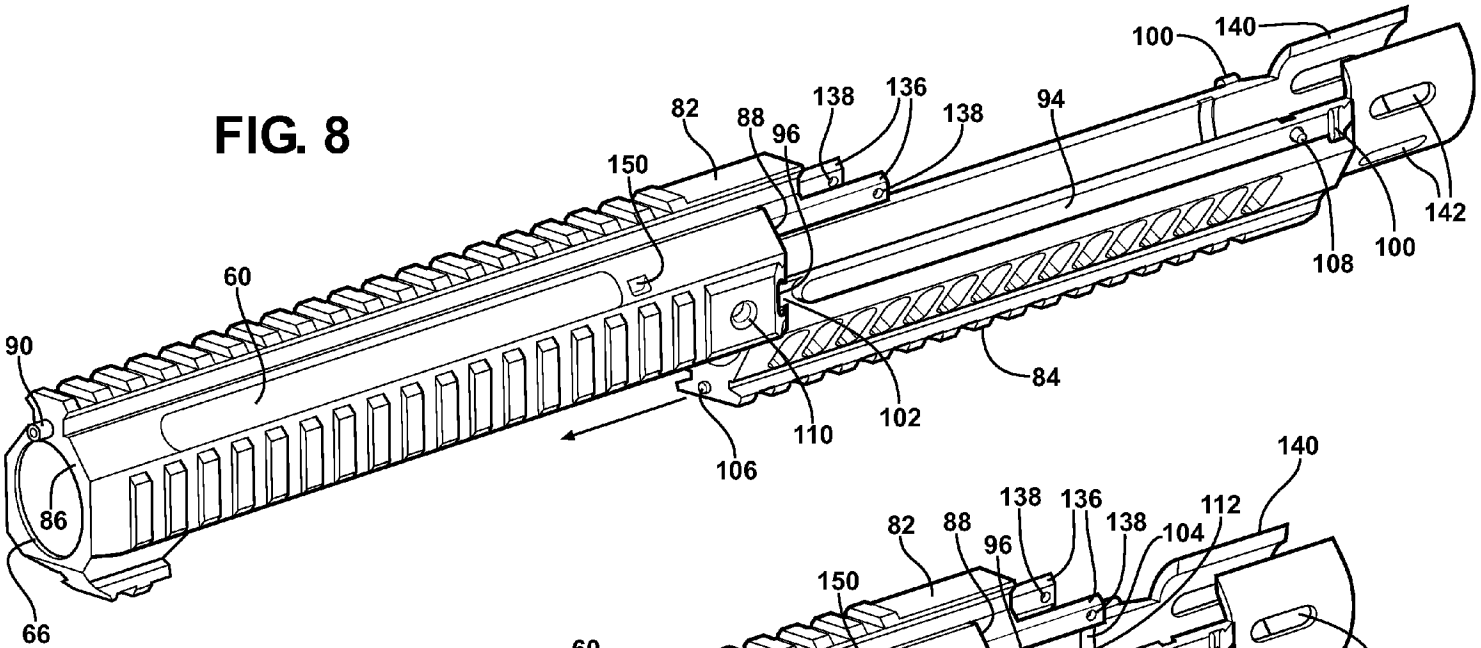
FIG. 8 is a perspective view of the hand guard including a first hand guard portion and a second hand guard portion in a disassembled position.
Figure 9:
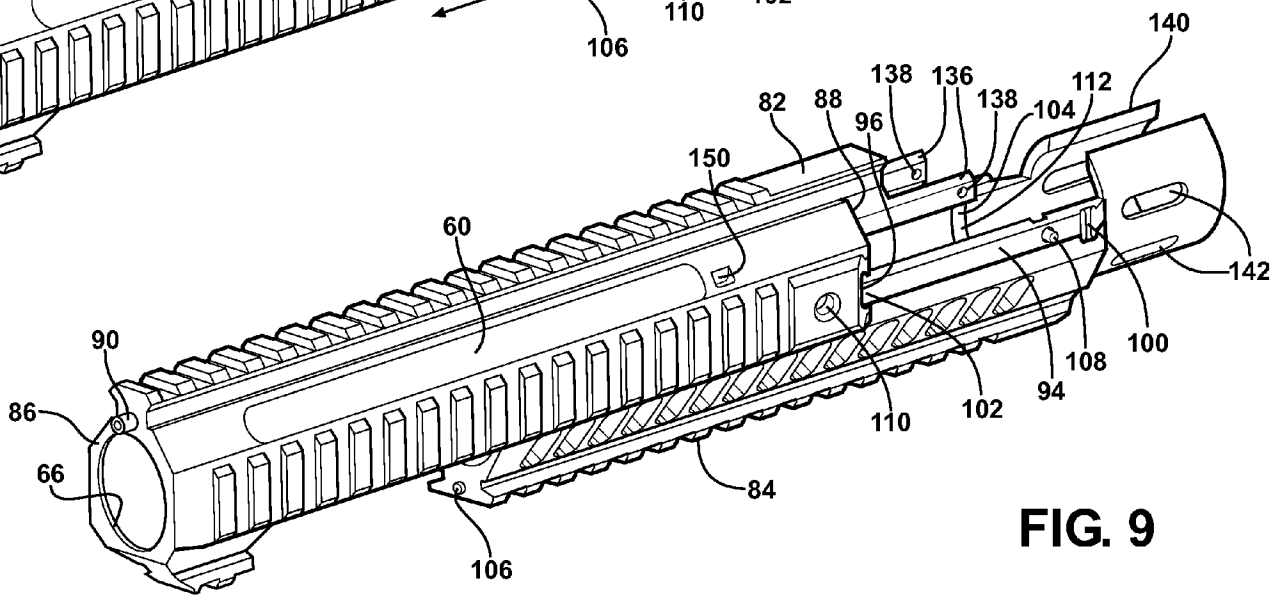
FIG. 9 is a perspective view of the hand guard with the second hand guard portion moved from the position of FIG. 8 toward an assembled position.

As shown in FIGS. 8 and 9, a bumper 106, preferably formed of an elastomeric material, is disposed on the second hand guard portion 84 between the first hand guard portion 82 and the second hand guard portion 84. The bumper 106 is compressed between the first hand guard portion 82 and the second hand guard portion 84 to eliminate any play that may exist between the first hand guard portion 82 and the second hand guard portion 84 when the securing device 104 couples the first hand guard portion 82 to the second hand guard portion 84.

The securing device 104 includes a button 108 that engages the first hand guard portion 82 and the second hand guard portion 84. The button 108 is coupled to the second hand guard portion 84 and the first hand guard portion 82 includes a button hole 110 for receiving the button 108 when the second hand guard portion 84 is in the assembled position.

With reference to FIGS. 3 and 7, a spring 112 is attached to the second hand guard portion 84 and to the button 108 with the spring 112 and the button 108 disposed in the hand guard bore 62. The first hand guard portion 82 typically defines a channel 114 for receiving the spring 112. The spring 112 resiliently biases the button 108 into engagement with the button hole 110 when the second hand guard portion 84 is in the assembled position. Preferably, the spring 112 and the button 108 are coupled to the second hand guard portion 84 and the button hole 110 is defined in the first hand guard portion 82. However, alternatively, spring 112 and the button 108 could be coupled to the first hand guard portion 82 with the button hole 110 defined in the second hand guard portion 84.

The button 108 and the spring 112 can be integrally formed or can be attached to each other in any way such as, for example, welding, riveting, adhering, etc. The spring 112 is typically attached to the second hand guard portion 84 by rivets 116; however, the spring 112 can be attached to the second hand guard portion 84 in any way without departing from the nature of the present invention.

As shown in FIGS. 12 and 13, the first hand guard portion 82 includes a ramp 118 in the hand guard bore 62 adjacent the button hole 110. The button 108 rides along the ramp 118 to load the spring 112 such that when the button 108 reaches the button hole 110, the spring 112 unloads and forces the button 108 into the button hole 110. FIG. 12 shows the button 108 riding along the ramp 118 and loading the spring 112. FIG. 13 shows the button 108 engaged with the button hole 110 and retained in the button hole 110 by the spring 112 when the second hand guard portion 84 is in the assembled position.

The spring 112 shown in the Figures is a single strip 120 of curved material, typically metal. The strip 120 has a shape such that, when attached to the second hand guard portion 84, the spring 112 urges the button 108 toward the first hand guard portion 82. The strip 120 resiliently deforms as the button 108 rides along the ramp 118. The strip 120 continuously urges the button 108 toward the first hand guard portion 82 such that when the button 108 reaches the button hole 110, the strip 120 urges the button 108 into the button hole 110. Alternatively, the spring 112 can be of any type to urge the button 108 into engagement with the button hole 110 when the second hand guard portion 84 is in the assembled position.

When in the assembled position, the second hand guard portion 84 can be selectively moved to the disengaged position after being disengaged from the first hand guard portion 82. To do so, the button 108 is pushed into the hand guard bore 62 to disengage the button 108 from the button hole 110. With the button 108 disengaged from the hand guard bore 62, the second hand guard portion 84 can be slid along ribs 94 and grooves 92 to the disassembled position. The button 108 can be pushed into the hand guard 38 with, for example, the bullet of a live round. The configuration of the securing device 104 is advantageous in that the first hand guard portion 82 and the second hand guard portion 84 are firmly secured to one another when the second hand guard portion 84 is in the assembled position and yet the second hand guard portion 84 can be quickly and easily disassembled to access the barrel 42, piston assembly 18, barrel nut 74, hand guard nut 68, etc., without the need for specialized tools With reference to FIG. 3, the barrel 42 defines a gas port (not shown) in communication with the bore. A gas block 124 is supported by the barrel 42 and is in communication with the gas port and the piston assembly 18 to direct exhaust gas from the barrel 42 to the piston assembly 18. Specifically, a tube 126 connects the gas block 124 and the piston assembly 18.

Figure 17:
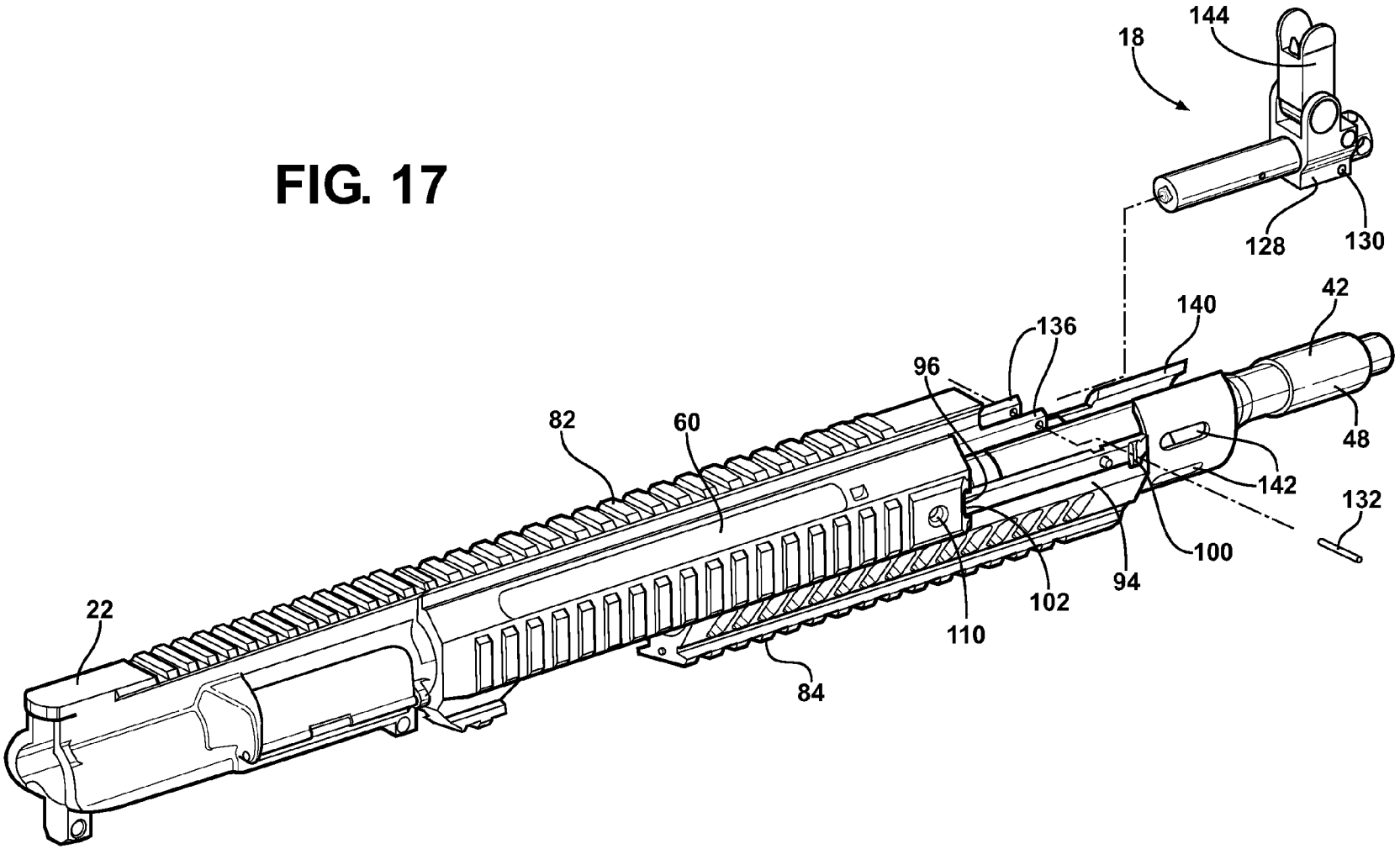
FIG. 17 is a partially exploded view of the receiver, the hand guard, a barrel, and a piston assembly.

Referring to FIG. 17, the piston assembly 18 is supported entirely by the hand guard 38, i.e., is not supported by the barrel 42. A body 128 supports the piston assembly 18 and is attached to the first hand guard portion 82. The body 128 defines an orifice 130. A mounting pin 132 extends through a section of the first hand guard portion 82 and the orifice 130 along a pin axis P to attach the piston assembly 18 to the hand guard 38.

The first hand guard portion 82 includes a projection 134 extending along the longitudinal axis L for supporting the piston assembly 18. Specifically, the projection 134 is preferably further defined as a pair of fingers 136 with the piston assembly 18 disposed between the pair of fingers 136. Each finger of the pair of fingers 136 defines a second orifice 138 extending along the pin axis P for receiving the mounting pin 132. The piston assembly 18 can be disassembled from the first hand guard portion 82 by merely removing the mounting pin 132 from the body 128 and the pair of fingers 136.

As best shown in FIGS. 11 and 17, the second hand guard portion 84 has a cover 140 at least partially covering the body 128 of the piston assembly 18 when the second hand guard portion 84 is in the assembled position to prevent removal of the piston assembly 18. Specifically, the cover 140 intersects the pin axis P when the second hand guard portion 84 is in the assembled position to prevent removal of the mounting pin 132 from the orifice 130. The cover 140 radially extends around the longitudinal axis L from one of the pair of fingers 136 to the other of the pair of fingers 136.

As shown in FIGS. 9 and 17, when the second hand guard portion 84 is in the disassembled position, the body 128 of the piston assembly 18 is exposed to permit removal of the piston assembly 18. Specifically, the mounting pin 132 is exposed and can be removed when the second hand guard portion 84 is in the disassembled position. The piston assembly 18 is easily assembled and disassembled to the hand guard 38 as a unit.

The cover 140 defines gas outlets 142 for exhausting gas from the piston assembly 18. The gas outlets 142 are arranged about the cover 140 to diffuse the exhaust gas and to direct the exhaust gas away from the user.

An extension 144 is mounted to the body 128. The body 128, the extension 144, and the piston assembly 18 define a sight assembly 146 that is supported by the hand guard 38. As such, the sight assembly 146 is in communication with the gas port 122 for receiving exhaust gas from the barrel 42 and can be removed as a unit.

The components described above allow for quick and easy assembly and disassembly. To assemble the components described above, the first hand guard portion 82 is placed abutting the receiver 22 with the flange 66 surrounding the threaded end 64. The hand guard nut 68 is then threadedly engaged with the threaded end 64 of the receiver 22 to attach the first hand guard portion 82 to the receiver 22. The shoulder 72 of the barrel 42 is then inserted into the hand guard nut 68 abutting the threaded end 64 of the receiver 22. The barrel nut 74 is inserted into the hand guard nut 68 and threadedly engaged with the hand guard nut 68 to attach the barrel 42 to the receiver 22. The body 128 is placed between the pair of fingers 136 and the mounting pin 132 is engaged with the body 128 and the pair of fingers 136. The tube 126 is connected to the piston assembly 18 and to the gas block 124. The ribs 94 of the second hand guard portion 84 are aligned with the open ends 96 of the grooves 92 and the second hand guard portion 84 is slid along the grooves 92 until the ears engage the enlarged sections 102 and the button 108 engages the button hole 110. To disassemble, the button 108 is disengaged from the button hole 110 and the previously described steps are reversed.

The firearm 10 described herein is designed to permit easy retro-fitting of the components to a variety of currently and/or previously manufactured firearm 10 designs including direct gas impingement systems and indirect gas impingement systems. For example, the firearm 10 components described herein may be retro-fitted to the M16, the M4®, such as the M4® carbine and the AR-15®, such as the AR-15® Platform. A first embodiment of the firearm 10 can be a version of the M4®, including a shorter barrel 42 typically associated with the M4®, is shown in FIGS. 1 through 17. A second embodiment of the firearm 10 can be a version of the M16, including a longer barrel 42 typically associated with the M16, is shown in FIGS. 18-22. It is to be appreciated that there are several different manufacturers producing firearms 10 having similar components, appearance and operation to the M16, the M4® and the AR-15®; therefore, the firearm 10 described herein is applicable to firearms 10 outside the M16, M4® and AR-15® designs.

Figure 18:
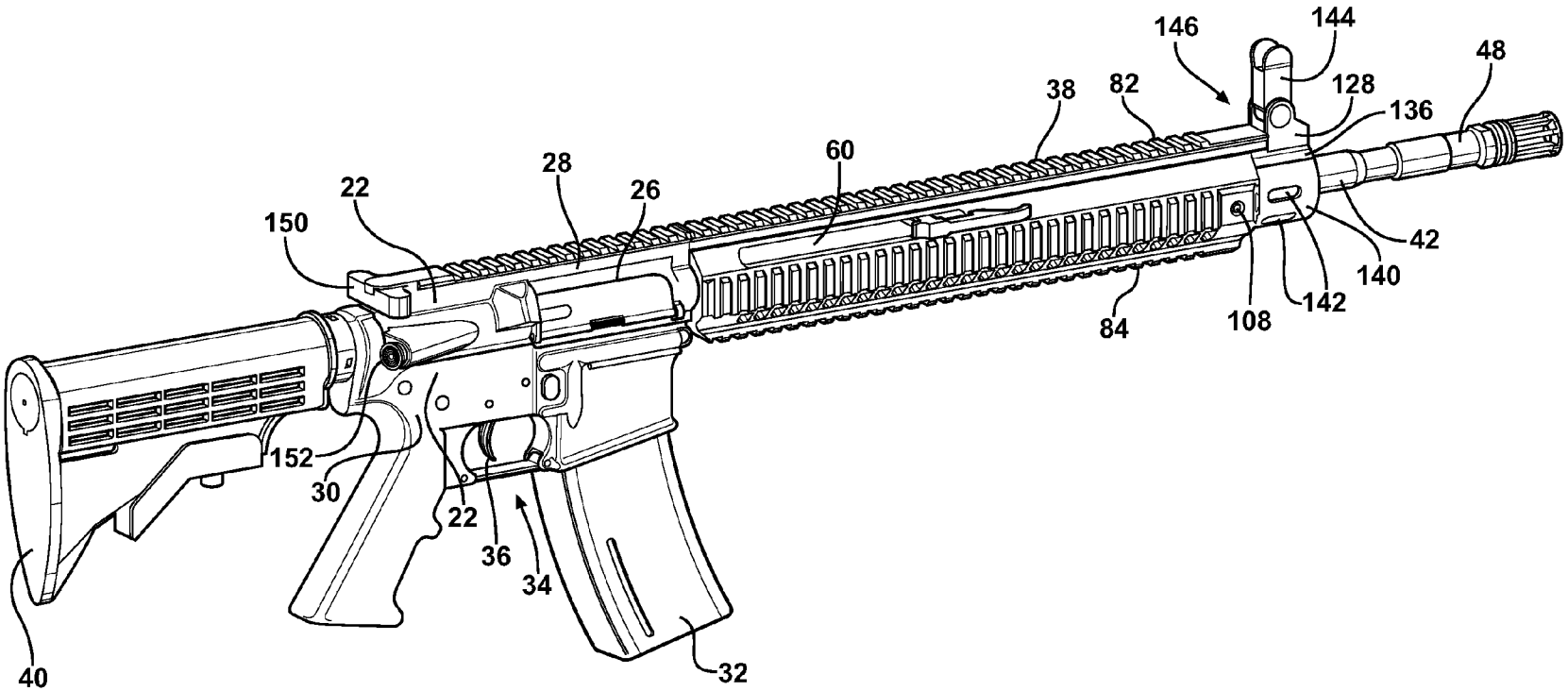
FIG. 18 is a perspective view of another embodiment of the firearm.
Figure 19:
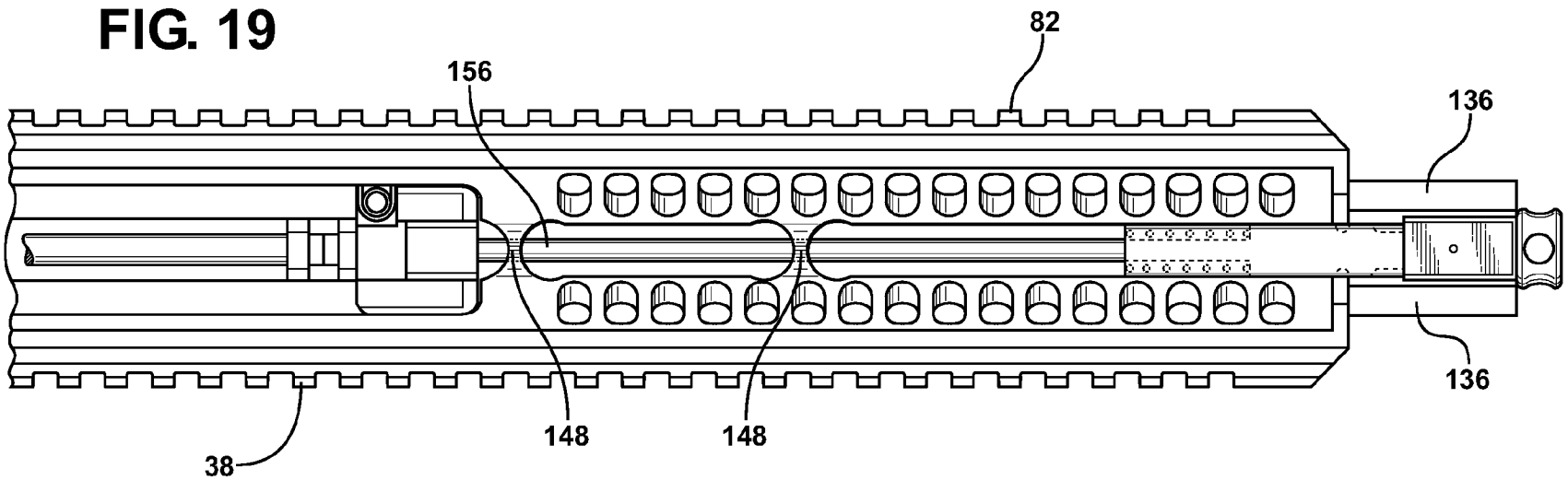
FIG. 19 is an interior perspective view of the first hand guard portion of the second embodiment of the firearm.
Figure 20:
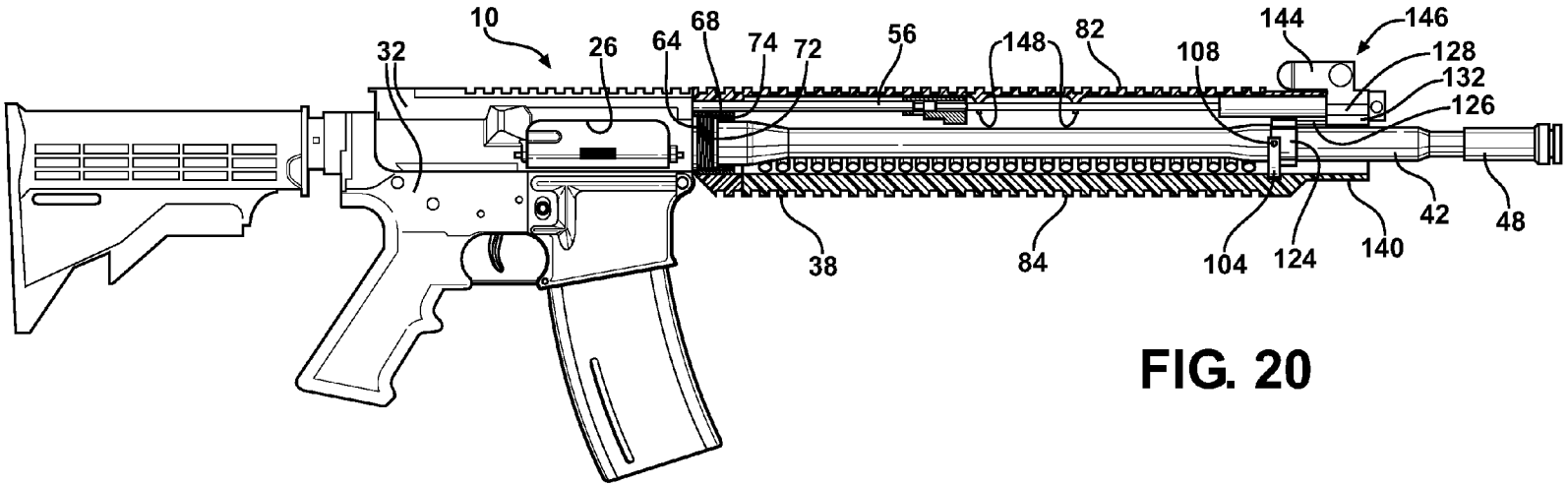
FIG. 20 is a partially cross-sectional view of the second embodiment of the firearm.
Figure 21:
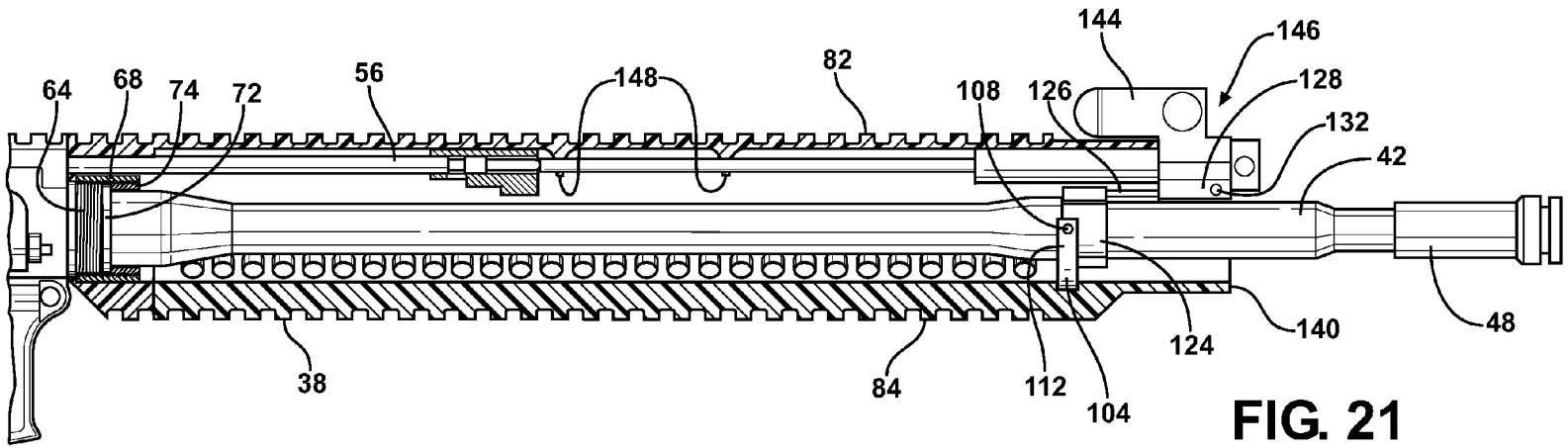
FIG. 21 is a magnified partially cross-sectional view of a portion of FIG. 20.
Figure 22:
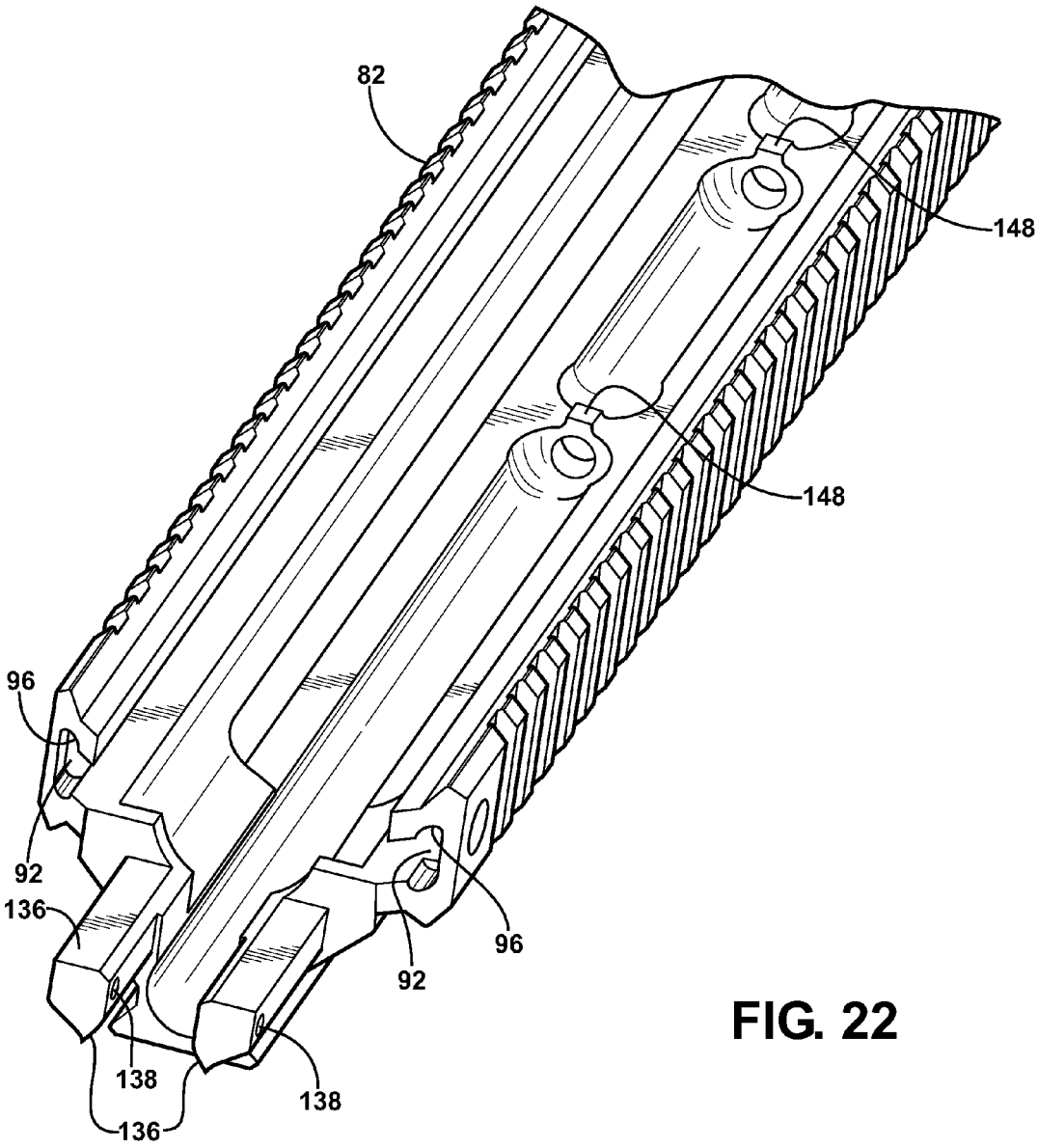
FIG. 22 is a perspective view of the first hand guard portion of the second embodiment of the firearm.

FIG. 18 shows a perspective view of the second embodiment of the firearm 10. The hand guard 38 is longer than that of the first embodiment to accommodate the longer barrel 42 of the second embodiment. Several features of the second embodiment are similar to those of the first embodiment, e.g., the flange 66, the hand guard nut 68, the barrel nut 74, the handle assembly 58, the fingers 136, and the piston assembly 18. The slots 60 do not extend along the entire length of the hand guard 38. Like the first embodiment of the firearm, the ribs and the grooves of the hand guard are continuous. As shown in FIGS. 19-22, the first hand guard portion 82 includes additional bushings 148 for receiving and supporting the rod 56. Other components such as the handle assembly are common between the two embodiments of the firearm.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A firearm comprising:

a receiver defining a receiver bore extending along a longitudinal axis and including a threaded end;

a hand guard defining a hand guard bore extending along said longitudinal axis with said hand guard having a flange extending into said hand guard bore and abutting said receiver about said threaded end;

a barrel disposed within said hand guard bore abutting said threaded end; and a hand guard nut abutting said flange of said hand guard and threadedly engaging said threaded end of said receiver such that said flange is sandwiched between said hand guard nut and said receiver for attaching said hand guard to said receiver.

2. The firearm as set forth in claim 1 wherein said barrel includes a shoulder and further including a barrel nut abutting said shoulder of said barrel to sandwich said shoulder between said barrel nut and said threaded end.

3. The firearm as set forth in claim 2 wherein said barrel nut threadedly engages said hand guard nut for attaching said barrel to said receiver.

4. The firearm as set forth in claim 2 wherein said barrel nut includes external threads and wherein said hand guard nut includes internal threads threadedly engaging said external threads of said barrel nut.

5. The firearm as set forth in claim 2 wherein said barrel nut and said shoulder of said barrel are disposed in said hand guard nut.

6. The firearm as set forth in claim 1 wherein said hand guard includes a first hand guard portion attached to said receiver and extending from said receiver along said longitudinal axis about said barrel and a second hand guard portion removably attached to said first hand guard portion for providing access to said hand guard nut.

7. The firearm as set forth in claim 1 wherein said barrel defines a bore and a gas port in communication with said bore and further comprising a piston assembly supported by said hand guard and in communication with said gas port for receiving exhaust gas from the barrel.

8. The firearm as set forth in claim 1 further comprising a bolt carrier disposed in said receiver bore.

9. The firearm as set forth in claim 1 further comprising a sight assembly supported by said hand guard.

10. The firearm as set forth in claim 9 wherein said barrel defines a bore and a gas port in communication with said bore and wherein said sight assembly is in communication with said gas port for receiving exhaust gas from the barrel.

11. A firearm comprising:

a receiver;

a barrel extending from said receiver along a longitudinal axis and defining a bore and a gas port in communication with said bore;

a first hand guard portion attached to said receiver and extending from said receiver along said longitudinal axis about said barrel;

a second hand guard portion removably attached to said first hand guard portion and extending along said longitudinal axis about said barrel with said second hand guard portion selectively moveable between an assembled position engaged with said first hand guard portion and a disassembled position disengaged with said first hand guard portion;

a piston assembly in communication with said gas port of said barrel for receiving exhaust gas from the barrel; and a body supporting said piston assembly and attached to said first hand guard portion;

said second hand guard portion having a cover at least partially covering said body when said second hand guard portion is in said assembled position to prevent removal of said piston assembly and exposing said body when said second hand guard portion is in said disassembled position to permit removal of said piston assembly.

12. The firearm as set forth in claim 11 wherein said body defines an orifice and further comprising a mounting pin extending through a section of said first hand guard portion and said orifice along a pin axis to attach said piston assembly to said hand guard.

13. The firearm as set forth in claim 12 wherein said cover intersects said pin axis when said second hand guard portion is in said assembled position to prevent removal of said mounting pin from said orifice.

14. The firearm as set forth in claim 12 wherein said first hand guard portion includes a projection extending along said longitudinal axis for supporting said piston assembly.

15. The firearm as set forth in claim 14 wherein said projection is further defined as a pair of fingers with said piston assembly disposed between said pair of fingers.

16. The firearm as set forth in claim 15 wherein said cover radially extends around said longitudinal axis from one of said pair of fingers to the other of said pair of fingers.

17. The firearm as set forth in claim 15 wherein each finger of said pair of fingers defines a second orifice extending along said pin axis for receiving said mounting pin.

18. The firearm as set forth in claim 11 further including an extension mounted to said body wherein said body, said extension, and said piston assembly define a sight assembly.

19. The firearm as set forth in claim 11 further comprising a gas block supported by said barrel and in communication with said gas port and said piston assembly to direct exhaust gas from said barrel to said piston assembly.

20. The firearm as set forth in claim 11 wherein one of said first and second hand guard portions includes a spring loaded button and the other of said first and second hand guard portions defines a button hole releasably receiving said button when said second hand guard portion is in said assembled position.

21. A firearm comprising:

a receiver extending along a longitudinal axis;

a first hand guard portion extending along said longitudinal axis with said first hand guard portion having a first end abutting said receiver and a second end spaced from said first end along said longitudinal axis;

a second hand guard portion extending along said longitudinal axis and selectively moveable between an assembled position engaged with said first hand guard portion and a disassembled position disengaged with said first hand guard portion;

a groove having an open end and a closed end spaced from each other along said longitudinal axis; and a rib complementary in configuration to said groove and extending along said longitudinal axis;

one of said groove and said rib defined on said first hand guard portion and extending from said second end of said first hand guard portion along said longitudinal axis and the other of said groove and said rib defined on said second hand guard portion such that said second hand guard portion is slideable along said longitudinal axis from said second end of said first hand guard portion toward said first end of said first hand guard portion to move said second hand guard portion from said disassembled position to said assembled position.

22. The firearm as set forth in claim 21 wherein said groove is continuous from said open end to said closed end.

23. The firearm as set forth in claim 21 wherein said rib is continuous along said groove from said open end to said closed end of said groove when said second hand guard portion is in said assembled position.

24. The firearm as set forth in claim 21 further comprising an ear extending from said rib adjacent said second end and wherein said groove includes an enlarged section adjacent said second end complementary configuration to said ear for interlocking said first and second hand guard portions.

25. The firearm as set forth in claim 21 further including a securing device coupled between said first and second hand guard portions for retaining said second hand guard portion to said first hand guard portion.

26. The firearm as set forth in claim 25 wherein said securing device includes a button and a spring attached to said button and attached to one of said first and second hand guard portions and wherein the other of said first and second hand guard portions defines a button hole receiving said button when said second hand guard portion is in said assembled position.

27. The firearm as set forth in claim 25 further including a barrel and wherein said first and second hand guard portions define a hand guard bore receiving said barrel and wherein said button and said spring are disposed in said hand guard bore.

28. The firearm as set forth in claim 25 wherein the other of said first and second hand guard portions include a ramp in said hand guard bore adjacent said button hole for loading said spring as said second hand guard portion is moved toward said assembled position.

* * * * *